US006105616A

United States Patent [19]

Sturman et al.

[11] Patent Number: 6,105,616

[45] **Date of Patent: *Aug. 22, 2000**

[54] DOUBLE ACTUATOR CONTROL VALVE THAT HAS A NEUTRAL POSITION

[75] Inventors: Oded E. Sturman; Steven Massey, both of Woodland Park, Colo.

[73] Assignee: Sturman Industries, Inc., Woodland Park, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/828,894

[22] Filed: Mar. 28, 1997

[51] Int. Cl.[7] ..... F15B 13/044

[52] U.S. Cl. ..... 137/625.65; 251/129.1

[58] Field of Search ..... 137/625.65; 251/129.1

[56] References Cited

U.S. PATENT DOCUMENTS

| | | | |
|---|---|---|---|
| 4,319,609 | 3/1982 | Debrus | 137/625.63 |
| 4,611,632 | 9/1986 | Kolchinsky et al. | 251/129.1 X |
| 4,741,365 | 5/1988 | Van Ornum | 251/129.1 X |
| 5,244,002 | 9/1993 | Frederick | 137/554 X |
| 5,251,671 | 10/1993 | Hiroki | 137/625.65 |
| 5,284,220 | 2/1994 | Shimizu et al. | 137/625.65 X |
| 5,460,329 | 10/1995 | Sturman | 251/129.1 X |
| 5,479,901 | 1/1996 | Gibson et al. | 137/625.65 X |
| 5,598,871 | 2/1997 | Sturman et al. . | |
| 5,638,781 | 6/1997 | Sturman | 123/90.11 X |
| 5,640,987 | 6/1997 | Sturman | 137/625.65 X |
| 5,829,396 | 11/1998 | Sturman et al. | 137/625.65 X |

FOREIGN PATENT DOCUMENTS

| | | | |
|---|---|---|---|
| 2209206 | 8/1973 | Germany | 137/625.65 |

*Primary Examiner*—Gerald A. Michalsky

*Attorney, Agent, or Firm*—Blakely, Sokoloff, Taylor & Zafman LLP

[57] ABSTRACT

A three position digitally latched actuator actuated fluid control valve. The control valve includes a housing which has a cylinder port, a supply port and a return port. The control valve also contains an internal valve that moves between a first position, a second position and a neutral position. In the first position the internal valve provides fluid communication between the cylinder port and the supply port. In the second position the valve provides fluid communication between the cylinder port and the return port. In the neutral position the valve prevents fluid communication between the ports. The control valve has a first actuator and a second actuator that are actuated by digital pulses to move the internal valve between the first, second and neutral positions. The control valve may have a pair of springs that bias the internal valve to the neutral position, wherein the actuator can be actuated to latch the valve into the first position and the second actuator can be actuated to latch the valve into the second position.

6 Claims, 4 Drawing Sheets

DOUBLE ACTUATOR CONTROL VALVE THAT HAS A NEUTRAL POSITION

BACKGROUND OF THE INVENTION

1. Field of the Invention

The present invention relates to a fluid control valve.

2. Description of Related Art

Hydraulic systems are commonly utilized in various vehicles, machines and equipment because of the mechanical advantage provided by hydraulic power. Most hydraulic systems contain a number of fluid control valves that control the actuation of the machine. The control valves typically switch states in response to an input command. The input command may be the rotation of a simple mechanical lever that moves an internal valve, or an electrical current which energizes a actuator and moves the internal valve. Actuator actuated valves can be coupled to a controller that can control the state of the valve and the actuation of the machine.

There are a number of different actuator actuated control valves. By way of example, there exist two-way valves, three-way valves, and four-way valves. A two-way valve includes two external ports and an internal valve which controls the flow of fluid through the valve. The internal valve is moved between two extreme positions. In one position the internal valve allows fluid communication between the ports. In the other position the internal valve prevents fluid communication between the ports. Two-way valves can provide an "on-off" switch for an hydraulic system.

Three-way valves contain a cylinder port, a supply port and a return port. Like the two-way valve, three-way valves contain an internal valve that moves between two extreme positions. In one position the internal valve couples the cylinder port to the supply port. In the other position the internal valve couples the cylinder port to the return port. Four-way valves have an additional second cylinder port and are constructed so that the first cylinder port is coupled to the supply port and the second cylinder port is coupled to the return port when the internal valve is in a first position. In the second valve position the first cylinder port is connected to the return port and the second cylinder port is connected to the supply port. By way of example, three-way control valves are used to control a spring return hydraulic piston. Four-way valves are used to control an hydraulic piston that does not have a spring return.

All three types of actuator actuated control valves have limitations on use within an hydraulic system. Two-way valves can only provide on and off functions. Three-way and four-way valves cannot be used to maintain a machine in an intermediate position. For example, when coupled to an hydraulic piston, three-way and four-way valves always couple the cylinder port(s) to either the supply or return lines. The piston is thus either fully extended or fully retracted. The system would require an additional two-way valve to maintain the piston at a location between the retracted and extended positions. It would be desirable to provide a actuator actuated control valve that has three positions.

SUMMARY OF THE INVENTION

The present invention is a three position digitally latched actuator actuated fluid control valve. The control valve includes a housing which has a cylinder port, a supply port and a return port. The control valve also contains an internal valve that moves between a first position, a second position and a neutral position. In the first position the internal valve provides fluid communication between the cylinder port and the supply port. In the second position the valve provides fluid communication between the cylinder port and the return port. In the neutral position the valve prevents fluid communication between the ports. The control valve has a first actuator and a second actuator that are actuated by digital pulses to move the internal valve between the first, second and neutral positions. The control valve may have a pair of springs that bias the internal valve to the neutral position, wherein the actuator can be actuated to latch the valve into the first position and the second actuator can be actuated to latch the valve into the second position.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
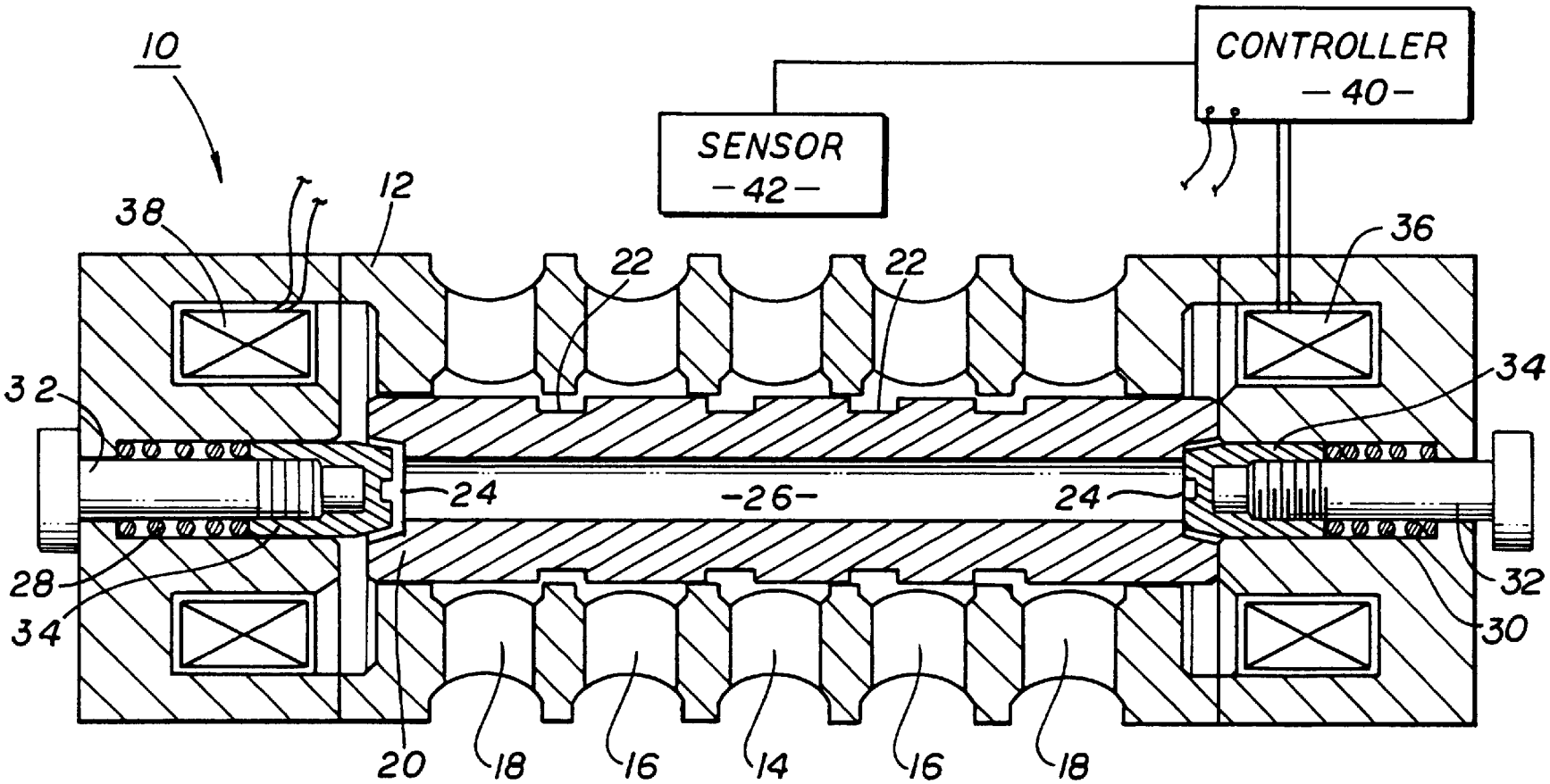
FIG. 1 is a cross-sectional view of a control valve of the present invention in a first position.

Referring to the drawings more particularly by reference numbers, FIG. 1 shows a fluid control valve 10 of the present invention. The control valve 10 includes a housing 12 which has a return port 14, a pair of cylinder ports 16 and a pair of supply ports 18. The supply ports 18 are typically connected to a pressurized fluid line of an hydraulic system. The return port 14 is typically connected to a drain line of the system. The cylinder ports 16 are typically connected to a mechanism such as an hydraulic piston, a fuel injector or an intake/exhaust valve of an internal combustion engine. Although a three-way valve is shown and described it is to be understood that the control valve 10 may be a four-way valve.

The control valve 10 has an internal spool valve 20 that controls the flow of fluid through the ports 14, 16 and 18. The spool 20 contains a plurality of grooves 22 that can allow fluid to flow between adjacent ports. The spool 20 is moved between a first position, a second position and a neutral position.

In the first position the spool 20 allows fluid communication between the cylinder ports 16 and the supply ports 18, and prevents fluid communication between the cylinder ports 16 and the return port 14. In the second position the spool 20 allows fluid communication between the cylinder ports 16 and the return port 14 and prevent fluid communication between the cylinder ports 16 and the supply ports 18. In the neutral position the spool 20 prevents fluid communication between any port 14, 16 or 18.

The cylinder ports 16 and supply ports 18 are preferably located on opposite sides of the return port 14 so that the valve is dynamically balanced when the spool 20 is in the first or second positions. Additionally, the spool 20 preferably contains a pair of outer end openings 24 that are connected by an inner channel 26. The openings 24 and channel 26 prevent fluid from being trapped between the ends of the spool 20 and the housing 12 and exerting a counteracting static force on the spool 20.

The spool 20 is biased into the neutral position by a first spring 28 and a second spring 30. The springs 28 and 30 are captured by the housing 12 and a pair of needles 32. Each needle 32 has an outer sleeve 34 that engages the end of the spool 20.

The control valve 10 includes a first actuator 36 and a second actuator 38 that move the spool 20 between the first, second and third positions. The actuators 36 and 38 are connected to a controller 40. The housing 12 and spool 20 are preferably constructed from a magnetic steel material which will retain enough magnetism to maintain the position of the spool 20 in the first or second positions even when power to the actuators is terminated. Such a construction allows the controller 40 to latch the spool 20 into the first or second positions by providing a digital pulse to one of the actuators 36 or 38. The present invention thus provides a three position digitally latched double actuator actuated control valve 10.

Figure 2:
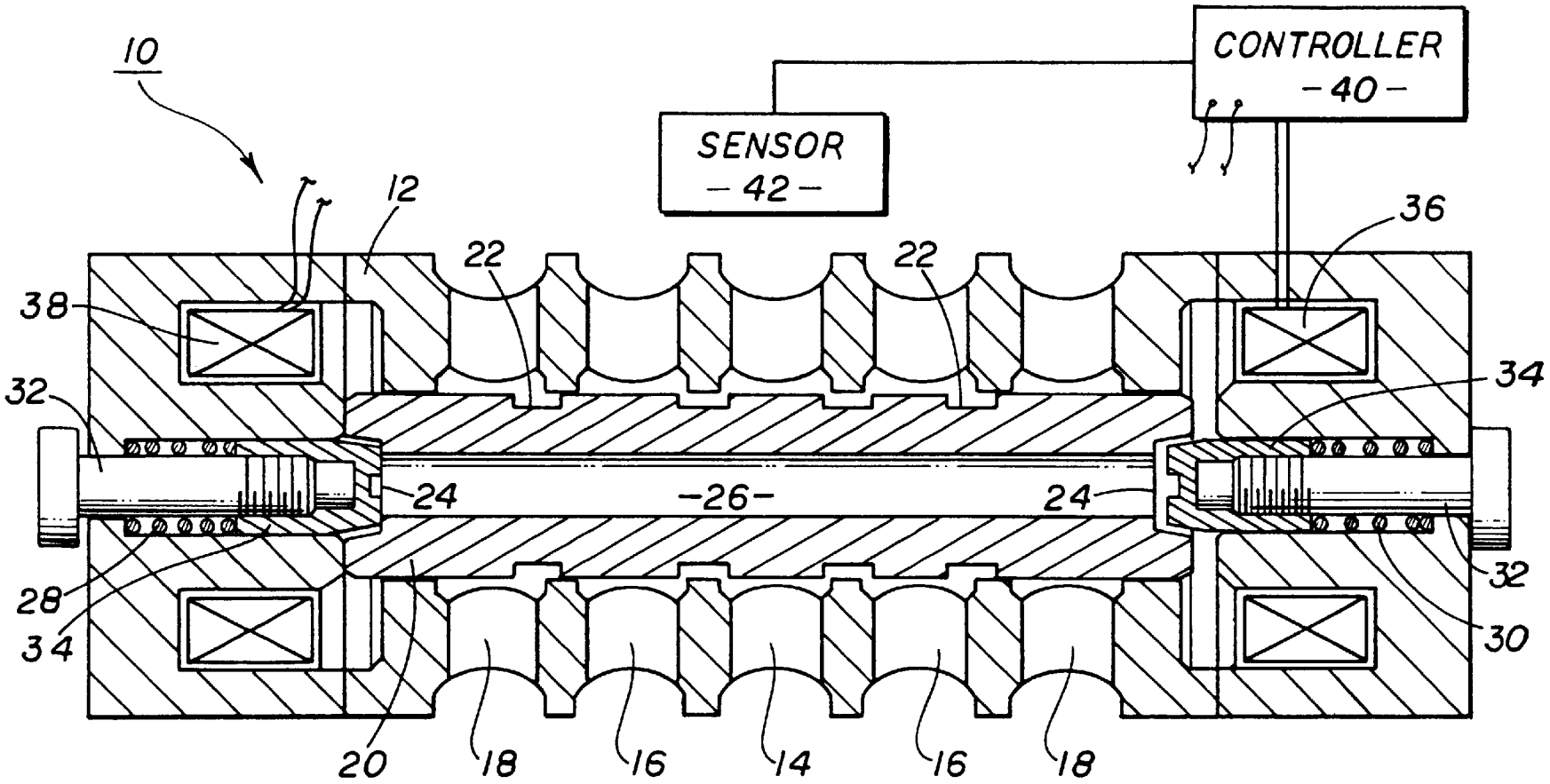
FIG. 2 is a cross-sectional view of the control valve in a second position.

In operation, as shown in FIG. 1, the spool 20 may be initially in the first position, such that fluid flows from the supply ports 18 to the cylinder ports 16. To couple the cylinder ports 16 to the return port 14 the controller 40 provides a digital pulse to the second actuator 38. As shown in FIG. 2, the energized second actuator 38 pulls the spool 20 into the second position.

Figure 3:
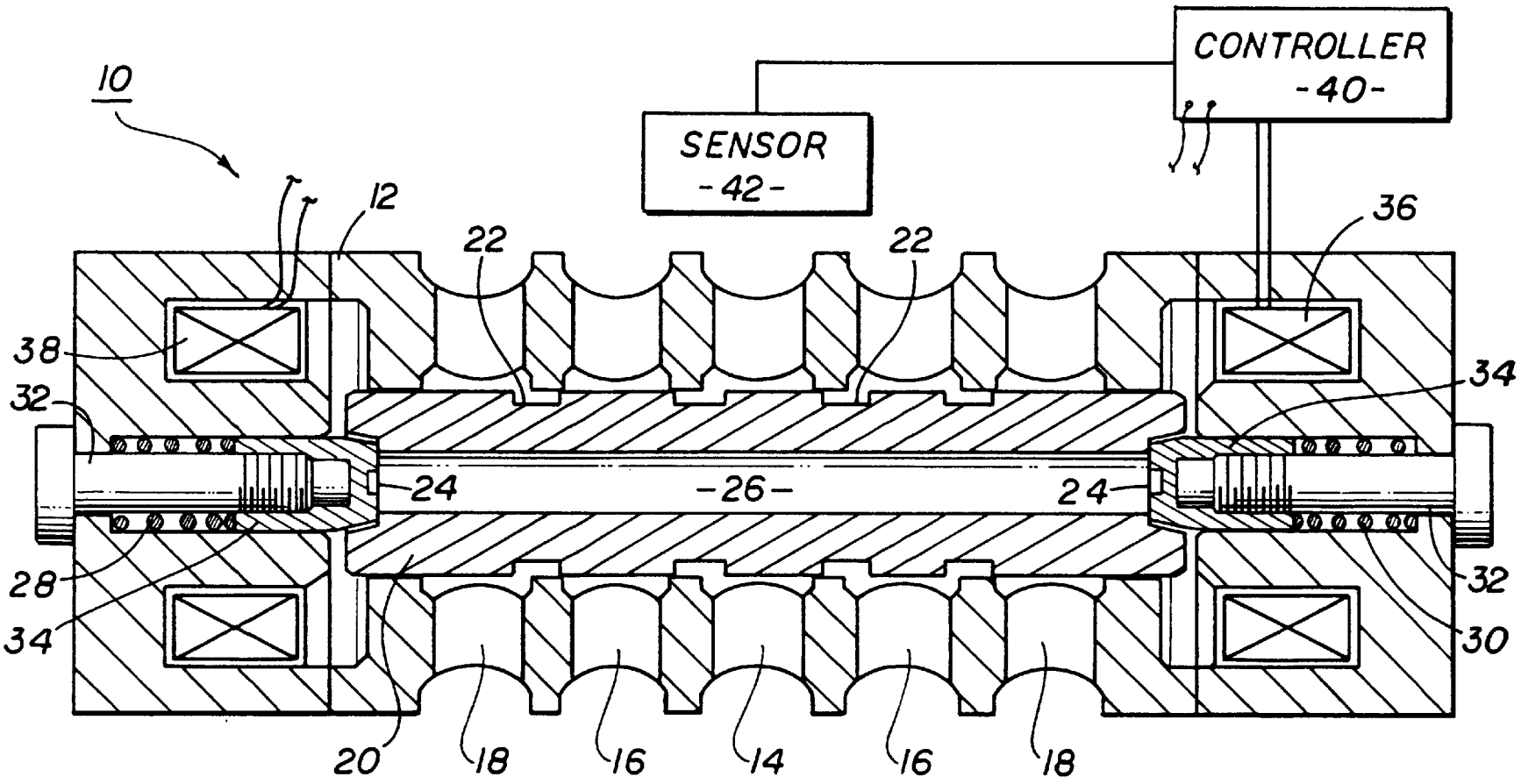
FIG. 3 is a cross-sectional view of the control valve in a neutral position.

As shown in FIG. 3, the spool 20 can be moved to the neutral position to block all fluid flow through the valve 10. The spool 20 may be moved to the neutral position by providing enough energy to the first actuator 36 to detach the spool from the second actuator 38. The energy provided to the first actuator 36 is too small to latch the spool 20 to the actuator 36, so that the springs 28 and 30 return the spool 20 to the neutral position. Alternatively, energy may be provided to the second actuator 38 to detach the spool 20 from the second actuator 38 and allow the springs 28, 30 to return the spool 20 to the neutral position.

The controller 40 may also provide digital signal to the first and second actuators to iteratively move the spool 20 to the neutral position. The valve 10 may have a position sensor 42, such as a Hall effect sensor, which senses the position of the spool 20 within the housing 12. The controller 40 can provide digital pulses to the actuators 36 and 38 until the position sensor 42 senses that the spool 20 is in the neutral position.

Figure 4:
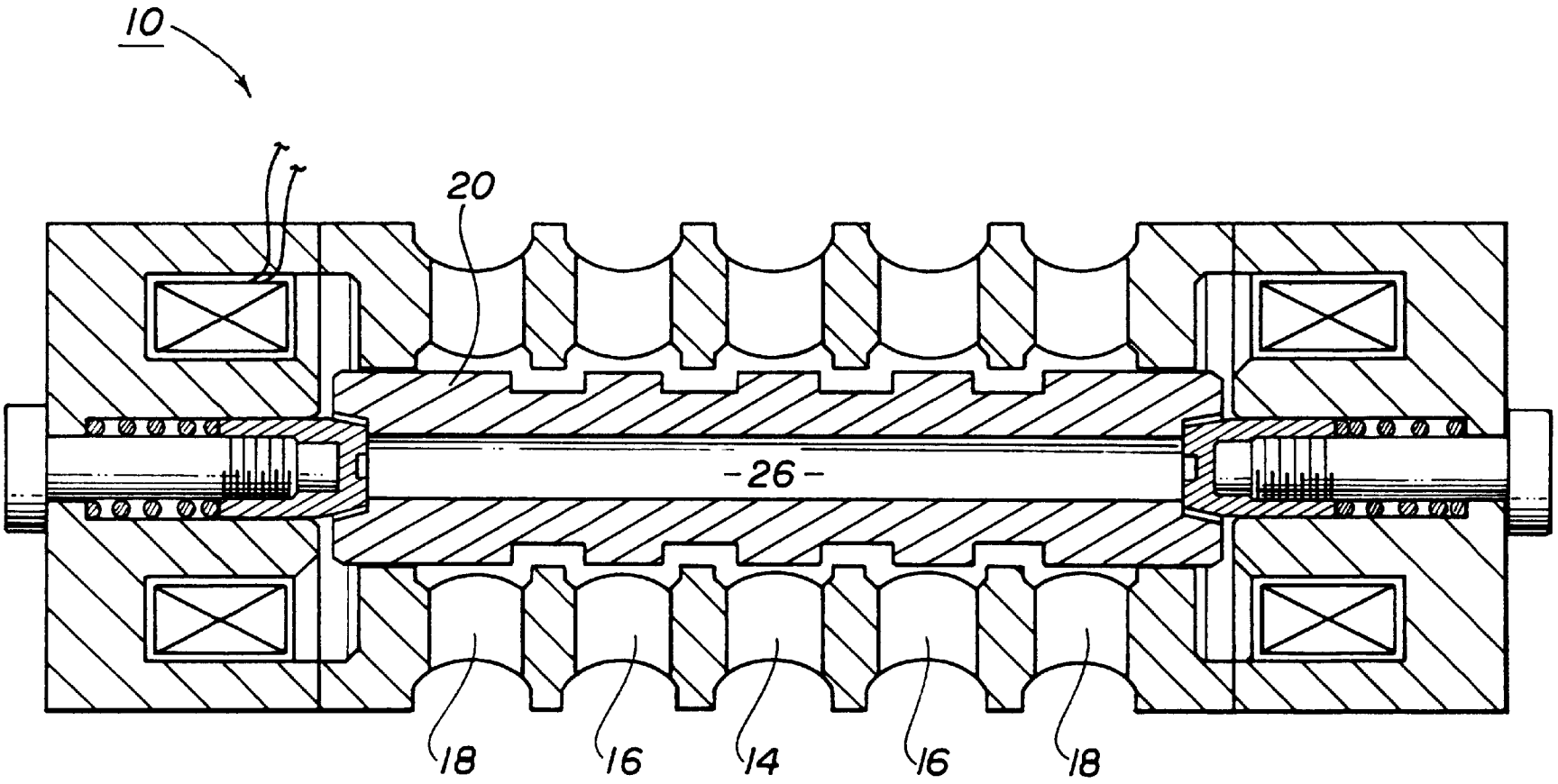
FIG. 4 is a cross-sectional view of an alternate embodiment of the control valve.

FIG. 4 shows an alternate embodiment, wherein the spool 20 allows fluid communication between all of the ports 14, 16 and 18 when in the neutral position.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A fluid control valve, comprising:

a housing which has a cylinder port, a supply port and a return port;

a valve that is located within said housing, said valve being movable between a first position which provides fluid communication between said cylinder port and said supply port, a second position which provides fluid communication between said cylinder port and said return port, and a neutral position which prevents fluid communication between said cylinder, return and supply ports;

a first actuator which can latch said valve in the first position;

a second actuator which can latch said valve in the second position;

controller means for providing electrical energy to energize said first and second actuators and latch said valve in the first or second positions, said controller means provides an electrical energy sufficient to de-latch said valve for movement into the neutral position; and, a plurality of springs that are coupled to said housing and bias said valve to the neutral position when said controller means de-latches said valve.

2. The control valve as recited in claim 1, wherein said springs are each captured by a needle and said housing.

3. The control valve as recited in claim 2, wherein said controller means provides a digital pulse to energize said first actuator and latch said valve into the first position.

4. The control valve as recited in claim 1, wherein said valve is a spool.

5. The control valve as recited in claim 4, wherein said spool has an inner channel that extends through a longitudinal axis of said spool.

6. The control valve as recited in claim 1, further comprising a position sensor that senses said positions of said valve.

* * * * *